US007699585B2

(12) United States Patent
Fukanuma et al.

(10) Patent No.: US 7,699,585 B2
(45) Date of Patent: Apr. 20, 2010

(54) SWASH PLATE TYPE COMPRESSOR

(75) Inventors: Tetsuhiko Fukanuma, Kariya (JP); Naoya Yokomachi, Kariya (JP); Masakazu Murase, Kariya (JP); Shingo Enami, Kariya (JP); Hajime Kurita, Kariya (JP); Seiji Katayama, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 1121 days.

(21) Appl. No.: 11/341,047

(22) Filed: Jan. 26, 2006

(65) Prior Publication Data

US 2006/0165536 A1 Jul. 27, 2006

(30) Foreign Application Priority Data

Jan. 27, 2005 (JP) ..... 2005-020290
May 23, 2005 (JP) ..... 2005-149679

(51) Int. Cl.
*F04B 1/26* (2006.01)

(52) U.S. Cl. ..... 417/222.2; 417/222.1; 91/499

(58) Field of Classification Search ..... 417/222.1, 417/222.2, 269; 91/499
See application file for complete search history.

(56) References Cited

U.S. PATENT DOCUMENTS 4,685,866 A 8/1987 Takenaka et al. ..... 417/222
7,377,754 B2 * 5/2008 Saiki et al. ..... 417/273
2002/0041809 A1 4/2002 Yokomachi et al.
2004/0118149 A1 6/2004 Tsunoda
2004/0197202 A1 10/2004 Saiki et al. ..... 417/269

FOREIGN PATENT DOCUMENTS

| | | |
|---|---|---|
| EP | 1 447 562 | 8/2004 |
| EP | 1 493 923 | 1/2005 |
| JP | 4-179874 | 6/1992 |
| JP | 5-018355 | 1/1993 |
| JP | 7-004353 | 1/1995 |
| JP | 08-284816 | 10/1996 |
| JP | 8-284816 | 10/1996 |

* cited by examiner

*Primary Examiner*—Devon C Kramer
*Assistant Examiner*—Patrick Hamo
(74) *Attorney, Agent, or Firm*—Locke Lord Bissell & Liddell LLP

(57) ABSTRACT

In a swash plate type compressor, refrigerant in a discharge pressure region is introduced into a crank chamber through a supply passage while the refrigerant in the crank chamber is drawn out to a suction pressure region through a bleed passage for controlling pressure in the crank chamber, whereby inclination angle of a swash plate is changed. A heat-generating sliding portion is provided in the crank chamber. The supply passage includes a communication port that communicates with the crank chamber and a first throttle portion for throttling the refrigerant. At least parts of the supply passage and the bleed passage are formed in a drive shaft. A part of the bleed passage formed in the drive shaft is located between a part of the supply passage formed in the drive shaft and an outer peripheral surface of the drive shaft.

14 Claims, 10 Drawing Sheets

SWASH PLATE TYPE COMPRESSOR

TECHNICAL FIELD

The present invention relates to a swash plate type compressor and more particularly to a structure for cooling heat-generating sliding portions of the swash plate type compressor.

A conventional swash plate type compressor is disclosed, for example, in the unexamined Japanese patent application publication No. 8-284816. FIG. 13 shows the structure of such swash plate type compressor. In the swash plate type compressor 50 of FIG. 13, pressure in the crank chamber 51 (crank chamber pressure Pc) is controlled for changing the inclination angle of the swash plate 1, thereby adjusting the displacement of the compressor 50.

The front housing 55 of the compressor 50 has a passage 56 formed therein. A drive shaft 58 has a communication passage 59 formed therein. The crank chamber 51 is sealed by a lip seal 57 which is provided between the front housing 55 and the outer peripheral surface of the drive shaft 58.

To control the crank chamber pressure Pc, part of refrigerant in the discharge chamber 54 is introduced into the crank chamber 51 with its flow rate being adjusted by the control valve 53. Refrigerant introduced into the crank chamber 51 is used to create the crank chamber pressure Pc and then flows through the passage 56 in the front housing 55, the communication passage 59 in the drive shaft 58 and other passages formed in the compressor 50 finally into the suction chamber 60, as indicated by arrows.

The refrigerant contains lubricating oil which is supplied into the crank chamber 51 and then guided through the oil supply passage 63 and the passage 56 to the lip seal 57 together with refrigerant for lubricating the lip seal 57. The lubricating oil is finally drawn to the suction chamber 60 through the communication passage 59.

However, refrigerant introduced into the crank chamber 51 increases in temperature while it flows in the crank chamber 51, which impedes cooling of the heat-generating sliding portions of the compressor 50, such as the lip seal 57, a thrust bearing 61 and a link 62, requiring cooling during operation of the compressor 50.

The present invention is directed to providing a swash plate type compressor that can sufficiently cool the heat-generating sliding portions of the compressor.

SUMMARY

In accordance with the present invention, a swash plate type compressor has a housing, a drive shaft, a lug plate, a swash plate, a piston and a heat-generating sliding portion. The housing has a cylinder bore, a suction pressure region, a discharge pressure region and a crank chamber. The drive shaft is rotatably supported by the housing. The lug plate is secured to the drive shaft. The swash plate is tiltably coupled to the lug plate. The piston is coupled to the swash plate and reciprocally accommodated in the cylinder bore. Refrigerant in the discharge pressure region is introduced into the crank chamber through a supply passage while the refrigerant in the crank chamber is drawn out to the suction pressure region through a bleed passage for controlling pressure in the crank chamber, whereby inclination angle of the swash plate is changed. The heat-generating sliding portion is provided in the crank chamber. The supply passage includes a communication port that communicates with the crank chamber and a first throttle portion for throttling the refrigerant. At least parts of the supply passage and the bleed passage are formed in the drive shaft. A part of the bleed passage formed in the drive shaft is located between a part of the supply passage formed in the drive shaft and an outer peripheral surface of the drive shaft.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a first preferred embodiment of a swash plate type compressor 1 with reference to FIGS. 1 through 6.

Figure 1:
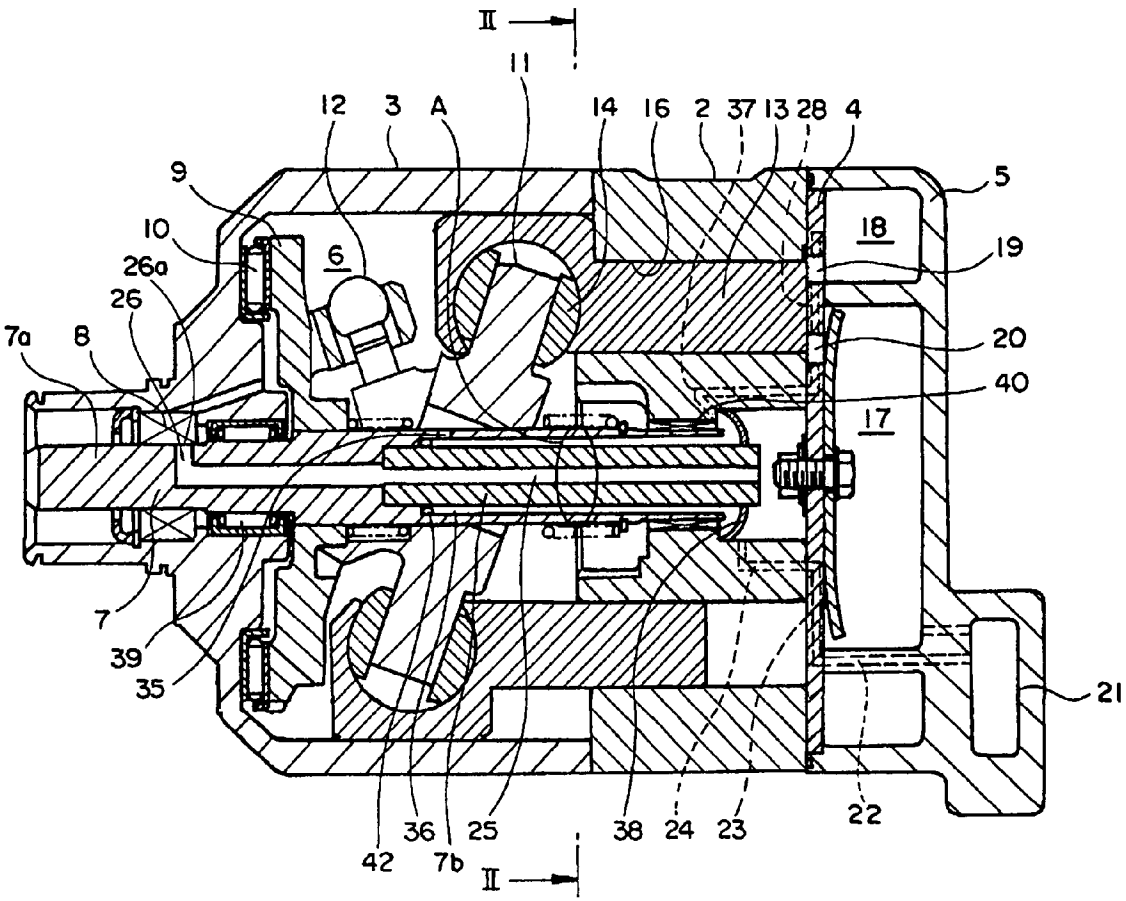
FIG. 1 is a cross-sectional view of a swash plate type compressor according to a first preferred embodiment of the present invention.

Referring to FIG. 1, the compressor 1 includes a cylinder block 2. It is noted that the left side and the right side of the compressor 1 as seen in FIG. 1 correspond to the front side and the rear side of the compressor 1, respectively. A front housing 3 is connected to the front end of the cylinder block 2. A valve port assembly 4 is connected to the rear end of the cylinder block 2. Furthermore, a rear housing 5 is connected to the rear end of the valve port assembly 4. The cylinder block 2 and the front housing 3 cooperate to form a crank chamber 6.

In the crank chamber 6, a drive shaft 7 is rotatably supported by the front housing 3 and the cylinder block 2. The drive shaft 7 includes a cylindrical hollow first shaft portion 7*a* having an opening at one end thereof and a cylindrical hollow second shaft portion 7*b* having openings at the opposite ends thereof and press-fitted in the opening of the first shaft portion 7*a*. An O-ring 42 is held between the inner peripheral surface of the first shaft portion 7*a* and the outer peripheral surface of the second shaft portion 7*b* adjacent to the front end of the second shaft portion 7*b*. The first shaft portion 7*a* is supported at the front and rear ends thereof by radial bearings 39 and 40, respectively.

A lip seal 8, which is one of the heat-generating sliding portions of the compressor 1, is provided between the outer peripheral surface of the front end portion of the drive shaft 7 and the front housing 3 for sealing of the crank chamber 6. In the crank chamber 6, a lug plate 9 is secured to the drive shaft 7 for rotation therewith. A thrust bearing 10 is provided between the lug plate 9 and the inner wall surface of the front housing 3.

A substantially disc-shaped swash plate 11 is tiltably fitted around the drive shaft 7 in the crank chamber 6 and tiltably coupled to the lug plate 9 through a link 12. A plurality of pistons 13 is arranged around the drive shaft 7 and coupled to the outer periphery of the swash plate 11 through a pair of shoes 14. Each of the pistons 13 is reciprocally accommodated in an associated cylinder bore 16, which is formed in the cylinder block 2. As the swash plate 11 is rotated, the pistons 13 are reciprocated in their associated cylinder bores 16.

A discharge chamber 17, which is a part of the discharge pressure region of the compressor 1, is formed at the center of the rear housing 5 and connected to an external refrigerant circuit through an outlet (not shown). On the other hand, a suction chamber 18, which is a part of the suction pressure region of the compressor 1, is formed around the discharge chamber 17 in the rear housing 5 and connected to the external refrigerant circuit through an inlet (not shown).

The valve port assembly 4 has suction ports 19, suction valves (not shown), discharge ports 20 and discharge valves (not shown). Each of the cylinder bores 16 is communicable with the suction chamber 18 through the respective suction port 19 and with the discharge chamber 17 through the respective discharge port 20. A retainer is provided on the rear side of the discharge ports 20.

A control valve 21 is provided in the rear housing 5 for adjusting the flow rate of refrigerant introduced into the crank chamber 6 thereby to control pressure in the crank chamber (crank chamber pressure Pc). The control valve 21 functions as a first throttle portion. The control valve 21 is in communication with the discharge chamber 17 through a passage on one hand and with one end of a passage 22 formed in the rear housing 5 on the other. The passage 22 extends from the control valve 21 toward the valve port assembly 4 and communicates with one end of a passage 23 formed in the valve port assembly 4. The other end of the passage 23 is in communication with one end of a passage 24 formed in the cylinder block 2 and the other end of the passage 24 is in communication with one end of a passage 25 formed axially in the drive shaft 7. The other end of the passage 25 is in communication with a passage 26 that communicates with the crank chamber 6. The passage 26 has a communication-port 26*a* which is radially opened to the crank chamber 6 and in communication with the lip seal 8. The control valve 21 and the passages 22, 23, 24, 25, 26 cooperate to form a supply passage for supplying refrigerant in the discharge pressure region into the crank chamber 6.

The drive shaft 7 has a passage 35 formed between the swash plate 11 and the lug plate 9 and having a communication port for drawing refrigerant and lubricating oil from the crank chamber 6 toward the suction chamber 18. The passage 35 is in communication with one end of a passage 36, the other end of which is in communication with one end of a passage 37 formed in the cylinder block 2. It is noted that a lip seal 38 is provided between the passage 36 and the passage 24. The passage 37 is in communication with one end of a passage 28 which is formed in the valve port assembly 4 and the other end of which communicates with the suction chamber 18. The passages 35, 36, 37, 28 cooperate to form a bleed passage for drawing refrigerant in the crank chamber 6 into the suction pressure region. The lip seal 38 is located at the rear end of the drive shaft 7 for sealing the bleed passage from the supply passage, that is, for sealing the inside of the second shaft portion 7*b* from the outside thereof. The lip seal 38 defines the supply passage in the drive shaft 7 together with the inner peripheral surface of the second shaft portion 7*b* and also defines the bleed passage in the drive shaft 7 together with the inner peripheral surface of the first shaft portion 7*a* and the outer peripheral surface of the second shaft portion 7*b*. It is noted that the supply passage and the bleed passage are so formed that the cross-sectional areas at any portion thereof are larger than that of the throttle of the control valve 21, so that the flow of refrigerant in such passages is not prevented.

Figure 2:
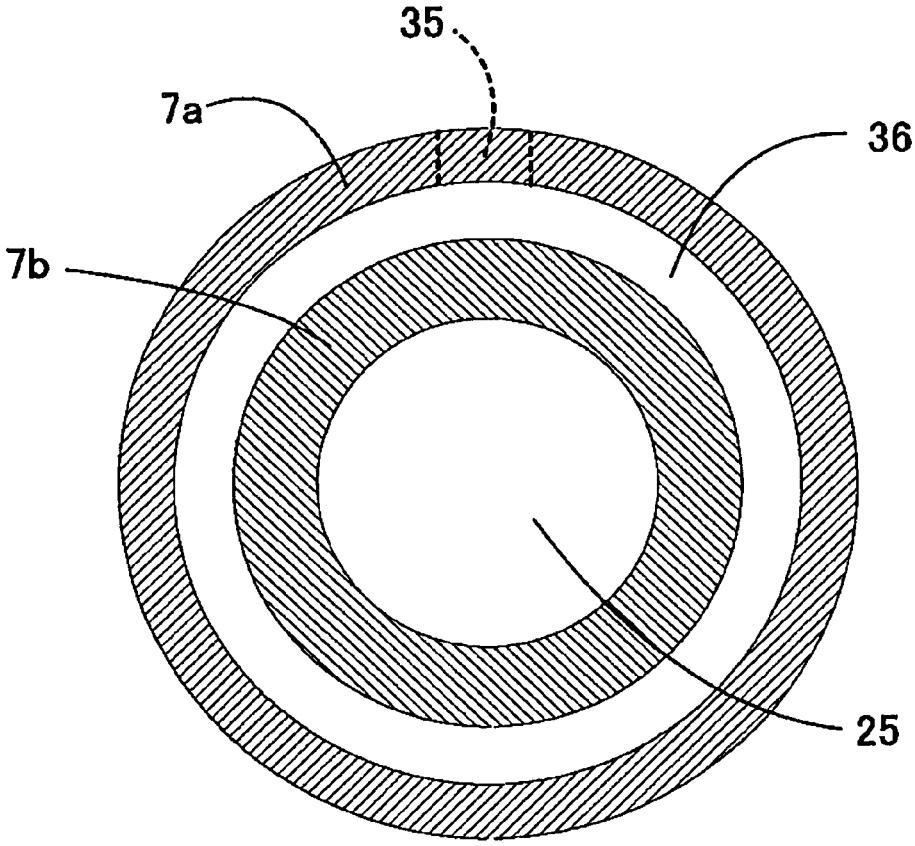
FIG. 2 is a cross-sectional view of a drive shaft of the swash plate type compressor according to the first preferred embodiment of the present invention.

FIG. 2 is an enlarged cross-sectional view of the drive shaft 7 that is taken along the line II-II of FIG. 1, that is, an enlarged view of the portion A of FIG. 1. As shown in FIG. 2, the passage 25 which is a part of the supply passage and the passage 36 which is a part of the bleed passage are formed coaxially in the drive shaft 7 as seen in the transverse cross-section across the axial direction thereof. To be more specific, the passage 36 is formed between the passage 25 in the second shaft portion 7*b* and the outer peripheral surface of the first shaft portion 7*a*, which is the outer peripheral surface of the drive shaft 7.

The following will describe the operation of the compressor 1 according to the first preferred embodiment.

As the drive shaft 7 is driven by a drive source (not shown), the swash plate 11 rotates, with the result that each of the pistons 13 reciprocates in the associated cylinder bore 16. Refrigerant in the external refrigerant circuit is introduced into the suction chamber 18 and then drawn through the respective suction ports 19 into the cylinder bores 16, in which the refrigerant is compressed by the pistons 13. The compressed refrigerant is forced into the discharge chamber 17 through the discharge ports 20 and then discharged out thereof into the external refrigerant circuit.

Part of refrigerant in the discharge chamber 17 is introduced into the crank chamber 6 for controlling the inclination angle of the swash plate 11. The flow rate of refrigerant introduced into the crank chamber 6 is controlled by adjusting the degree of opening of the control valve 21. When refrigerant passes through the control valve 21, the valve portion of the control valve 21 throttles or regulates the flow of refrigerant thereby to reduce its pressure and hence its temperature.

For example, refrigerant in the discharge pressure region subjected to a high pressure and has a temperature of about 150 degrees C. The refrigerant is lowered in pressure by passing through the control valve 21 and its temperature is dropped to approximately 100 degrees C. Refrigerant that has thus decreased in temperature passes through the passages 22, 23, 24, 25, 26 in this order and is introduced into the crank chamber 6 through the communication port 26*a*. Since refrigerant that has decreased in temperature and flows past the communication port 26*a* directly blows onto the lip seal 8 just after being introduced into the crank chamber 6, the lip seal 8 which generates heat during operation of the compressor 1 is cooled by refrigerant.

Refrigerant thus introduced into the crank chamber 6 serves to adjust the crank chamber pressure Pc in accordance with the degree of opening of the control valve 21, and the inclination angle of the swash plate 11 is controlled by the pressure difference between the crank chamber pressure Pc and the pressure in the cylinder bores 16, thus controlling the displacement of the compressor 1. That is, the inclination angle of the swash plate 11 may be changed by adjusting the crank chamber pressure Pc in the crank chamber 6. Refrigerant in the crank chamber 6 is drawn out to the suction chamber 18 through the passages 35, 36, 37, 28 in this order.

It is noted that lubricating oil contained in refrigerant in the crank chamber 6 is not uniformly distributed, but the oil content is less in the region between the swash plate 11 and the lug plate 9. One reason is that refrigerant containing lubricating oil is compelled away from the drive shaft 7 between the swash plate 11 and the lug plate 9 due to the rotating action and centrifugal force of the swash plate 11. Another reason is that refrigerant compelled away from the drive shaft 7 due to the operation of the swash plate 11 or other reasons attaches on the inner wall of the front housing 3 or other parts, and some lubricating oil may adhere thereto. Thus, there is less lubricating oil between the swash plate 11 and the lug plate 9. On the contrary, more lubricating oil is present in the parts other than between the swash plate 11 and the lug plate 9, namely, near the inner wall surface of the front housing 3 and between the swash plate 11 and the cylinder block 2.

Refrigerant that flows through the bleed passage, particularly through the passage 35, after cooling the lip seal 8, increases in temperature to a level that is still lower than the temperature of peripheral parts of the drive shaft 7, particularly the outer peripheral portion of the drive shaft 7.

Thus, the refrigerant which is decreased in temperature due to throttling by the valve portion of the control valve 21 when refrigerant is introduced into the crank chamber 6 is directly blown onto the lip seal 8. Therefore, the lip seal 8 which is heated during operation of the compressor 1 is cooled down by the refrigerant.

This cooling effect is synergistically improved by forming the passages 25, 36 in the drive shaft 7 with the passage 36 provided between the passage 25 in the drive shaft 7 and the outer peripheral surface of the first shaft portion 7*a*. That is, the passage 36, which is a part of the bleed passage, is formed to surround the passage 25, so that the passage 36 and refrigerant flowing therein prevent the heat on the outer peripheral side of the drive shaft 7 from being conducted to the passage 25. Therefore, the temperature of refrigerant in the passage 25 is kept at a lower level. Thus, refrigerant with lower temperature is directly blown onto the lip seal 8, so that the lip seal 8 is further effectively cooled.

Additionally, the bleed passage having a communication port 35 for drawing therethrough refrigerant and lubricating oil from the crank chamber 6 into the suction chamber 18 is provided at a position where the refrigerant contains less lubricating oil, rather than at a position near the lip seal 8 where the refrigerant contains more lubricating oil. Therefore, the amount of lubricating oil discharged out of the compressor 1 is reduced and a relatively large amount of lubricating oil is accumulated in the crank chamber 6, so that the compressor 1 is desirably operated during its off state where substantially no refrigerant is introduced, compressed and discharged, but the swash plate 11 is being rotated. Furthermore, the drive shaft 7 which has two passages in the form of cavities can be made advantageously light in weight.

In the first preferred embodiment, the first shaft portion 7*a* and the second shaft portion 7*b* are made of metal. In an alternative embodiment, the second shaft portion 7*b* is made of heat insulation material such as resin. In another alternative embodiment, the drive shaft 7 is provided with heat insulation treatment, for example, by coating the first shaft portion 7*a* and/or the second shaft portion 7*b* with heat insulation material or by fitting a hollow cylindrical heat insulation member on the inner or outer periphery of at least one of the first and second shaft portions 7*a*, 7*b* as a part of the drive shaft 7. The second shaft portion 7*b*, whose rigidity may be lower than that of the first shaft portion 7*a*, may be made of a heat insulation material with a lower rigidity.

Thus making part of the drive shaft 7 using a heat insulation material, the conduction of heat generated on the outer periphery of the drive shaft 7 to the passage 25 is prevented more effectively than without using the heat insulation material for the drive shaft 7. Thus, the cooling of the lip seal 8 is further improved.

Figure 3:
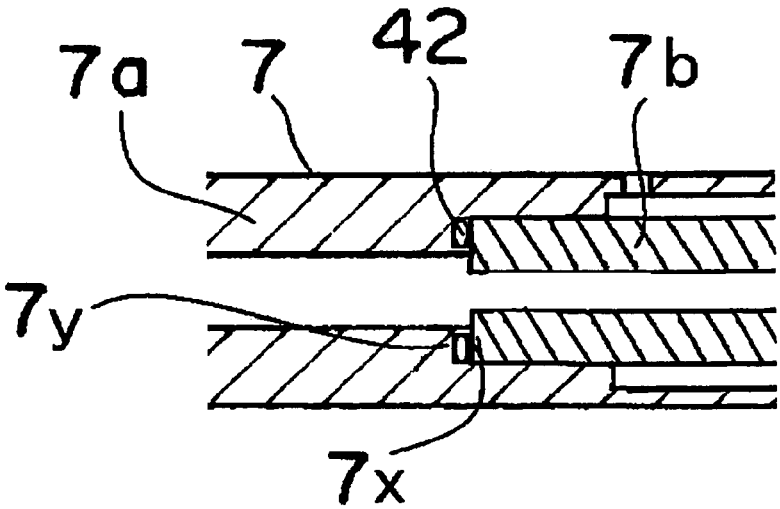
FIG. 3 is a cross-sectional view of a drive shaft of the swash plate type compressor according to an alternative embodiment to the first preferred embodiment of the present invention.

The position where the O-ring 42 is provided is not limited to a position between the inner peripheral surface of the first shaft portion 7*a* and the outer peripheral surface of the second shaft portion 7*b*. For example, the O-ring 42 may be provided between the front end 7*x* of the second shaft portion 7*b* and a step 7*y* which is formed on the inner peripheral surface of the first shaft portion 7*a* that is engaged with the front end 7*x*, as shown in FIG. 3.

Figure 4:
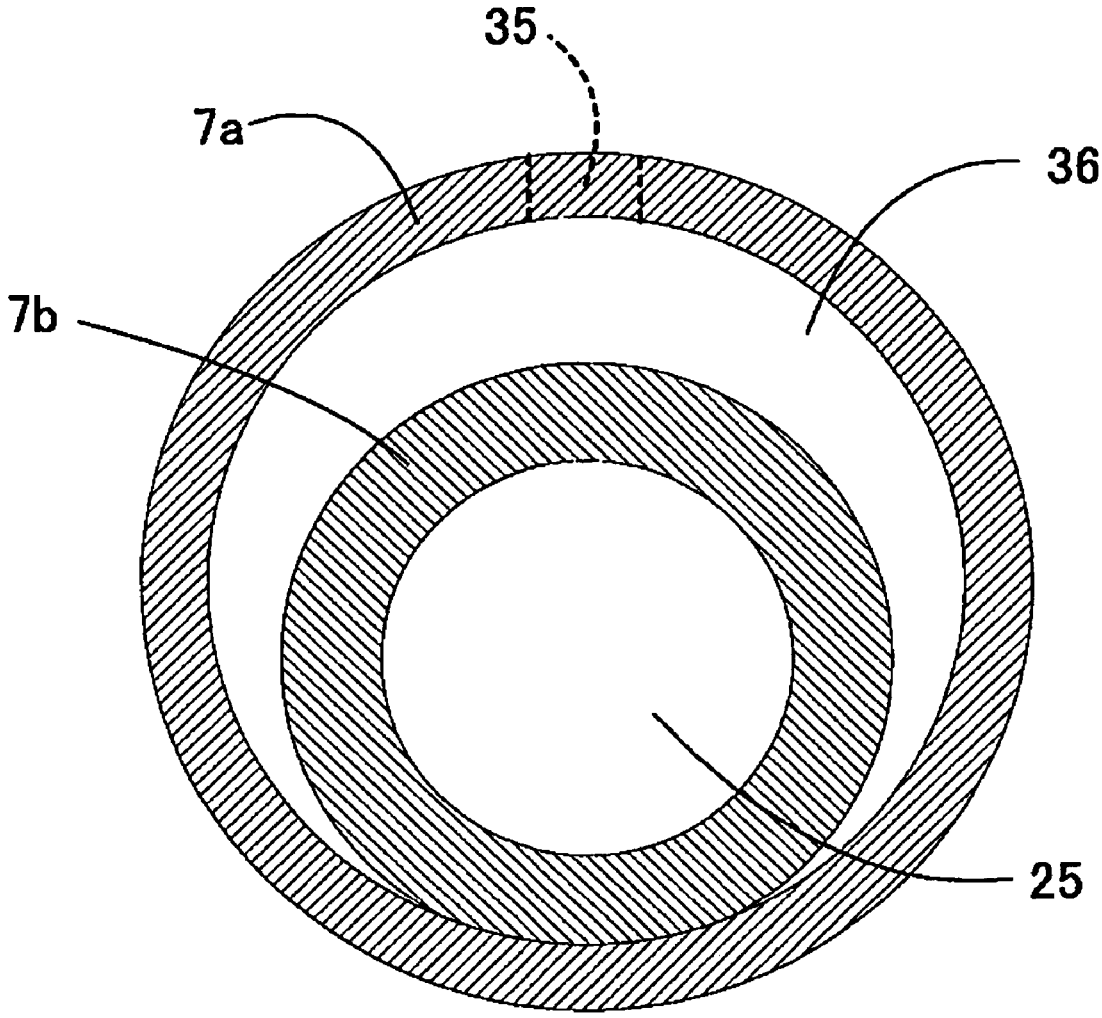
FIG. 4 is a cross-sectional view of a drive shaft of the swash plate type compressor according to an alternative embodiment to the first preferred embodiment of the present invention.
Figure 5:
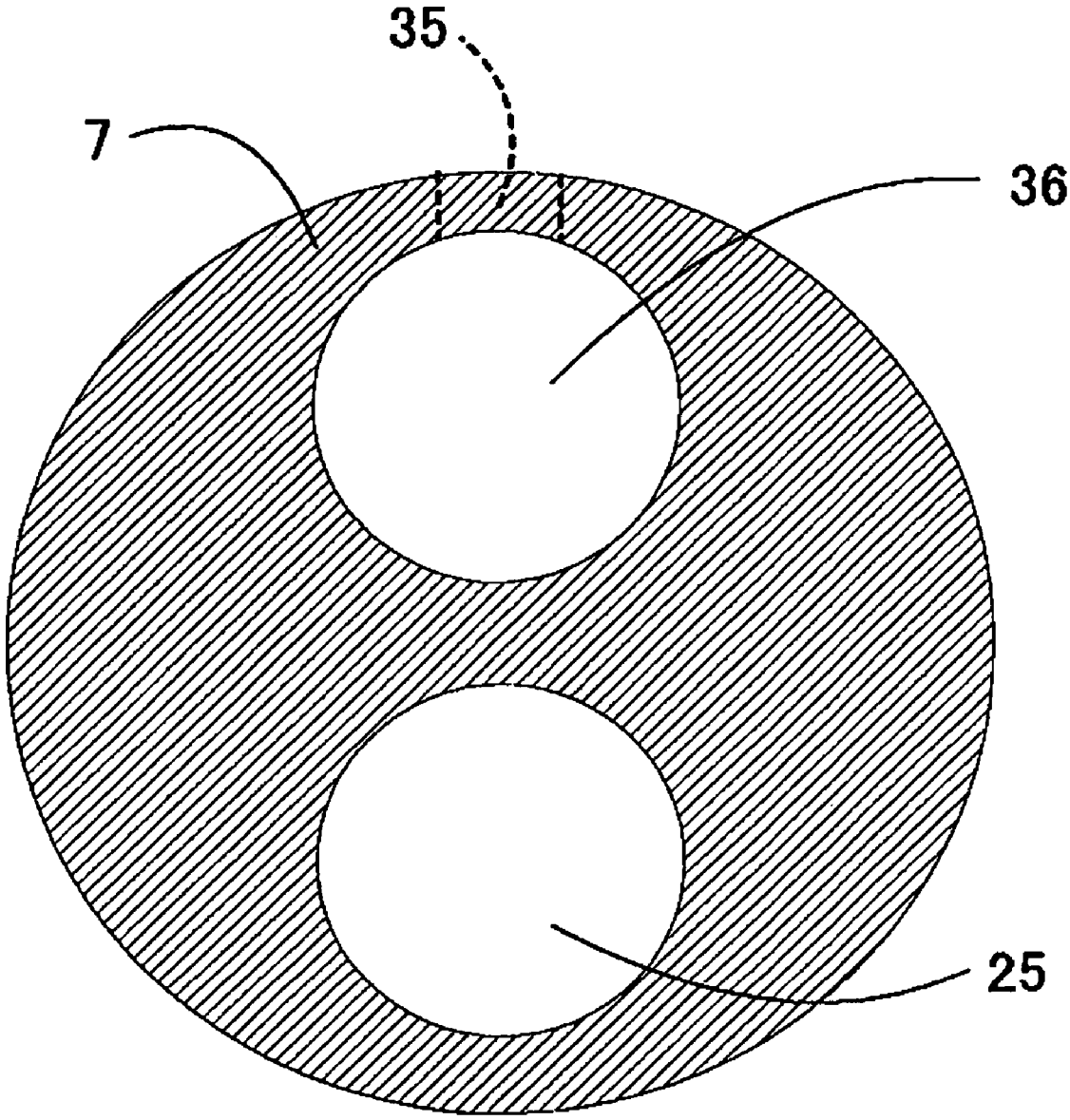
FIG. 5 is a cross-sectional view of a drive shaft of the swash plate type compressor according to an alternative embodiment to the first preferred embodiment of the present invention.
Figure 6:
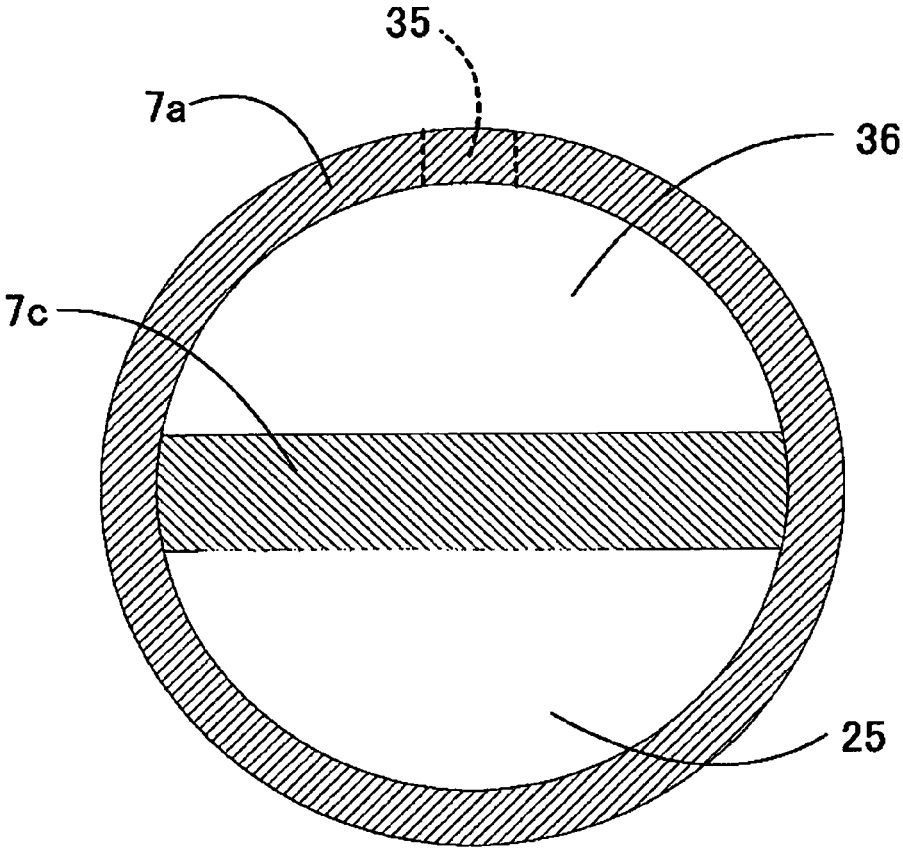
FIG. 6 is a cross-sectional view of a drive shaft of the swash plate type compressor according to an alternative embodiment to the first preferred embodiment of the present invention.

The shape of cross-section of the drive shaft 7 is not limited to that of FIG. 1, but the drive shaft 7 may be designed such that the passage 36 is provided between the passage 25 and the outer peripheral surface of the drive shaft 7 and that the passage 36 and the passage 25 are separated from each other, as exemplified in FIGS. 4 through 6.

In FIG. 4, the second shaft portion 7*b* is fitted to the first shaft portion 7*a* so that the axis of the second shaft portion 7*b* is offset from the axis of the first shaft portion 7*a*. A part of the inner peripheral surface of the first shaft portion 7*a* is in contact with a part of the outer peripheral surface of the second shaft portion 7*b*. In such arrangement of the shaft portions 7*a*, 7*b*, the second shaft portion 7*b* is easily assembled and supported.

In FIG. 5, the drive shaft 7 is formed of a single member having the passage 25 and the passage 36 formed side by side. Thus, the number of components of the compressor 1 is reduced. Each of the passage 25 and the passage 36 of FIG. 5 is circular in cross-section but it may have any other shape than circle such as an elliptical shape, an oblong shape, a shape including a circular arc and a straight line, and a polygonal shape.

In FIG. 6, the interior of the first shaft portion 7*a* is divided by a partition member 7*c* into two passages 25, 36. The partition member 7*c* has planar surfaces on the both sides, each constituting a part of the respective passages 25, 36. The planar surface may be replaced by a curved surface. Thus, the drive shaft 7 may be constructed simple by using the partition member 7*c* having a simple shape instead of the cylindrical second shaft portion 7*b*. In this case, the passage 36 is provided between the passage 25 and the outer peripheral surface of the first shaft portion 7*a*.

Furthermore, the position of the passage 35 in the drive shaft 7 is not limited to that between the swash plate 11 and the lug plate 9, but the passage 35 may be located closer to the lip seal 8 or near the front end of the crank chamber 6, that is, near the position where the drive shaft 7 contacts with the lug plate 9.

In such a case, the passage 36 becomes longer and, accordingly, the second shaft portion 7*b* is formed longer. Thus, the portion of the passage 25 where refrigerant flowing therein is thermally insulated by the passage 36 becomes longer, so that the heat on the outer peripheral side of the drive shaft 7 is effectively insulated and the lip seal 8 is further effectively cooled.

The target component of the compressor 1 to be cooled by refrigerant is the lip seal 8 in this embodiment of FIG. 1, but it is not limited to the lip seal 8. If the communication port 26*a* of the supply passage to the crank chamber 6 is located near the target component for cooling, other heat generating components such as the radial bearing 39, the thrust bearing 10 and the link 12.

The O-ring 42 which is held between the inner peripheral surface of the first shaft portion 7*a* and the outer peripheral surface of the second shaft portion 7*b* near the front end of the second shaft portion 7*b* may be omitted. That is, the inner peripheral surface of the first shaft portion 7*a* closely contacts with the outer peripheral surface of the second shaft portion 7*b* by press-fitting, thereby having a seal structure.

Figure 7:
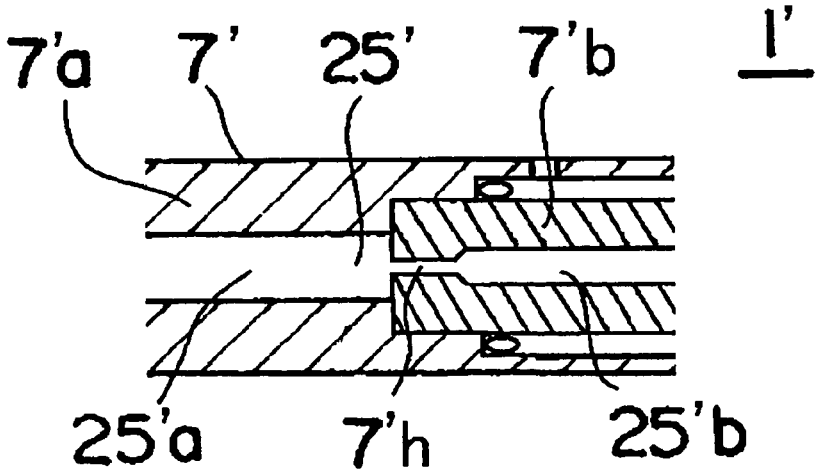
FIG. 7 is a partially cross-sectional view of a swash plate type compressor according to a second preferred embodiment of the present invention.

The following will describe a second preferred embodiment of a swash plate type compressor 1' according to the present invention with reference to FIG. 7. The second preferred embodiment differs from the first preferred embodiment in that an additional second throttle portion is provided in the supply passage between the control valve 21 as a first throttle portion and the communication port 26*a*. For example, the drive shaft 7' including the first shaft portion 7'*a* and the second shaft portion 7'*b* are modified as shown in FIG. 7. Those parts and elements of the compressor 1' which are not shown in FIG. 7 are the same as the counterparts of the first preferred embodiment.

As shown in FIG. 7, the second shaft portion 7'*b* has at the front end thereof a second throttle portion 7'*h* formed integrally therewith. The passage 25' includes a first passage part 25'*a* defined by the inner peripheral surface of the first shaft portion 7'*a* and a second passage part 25'*b* defined by the inner peripheral surface of the second shaft portion 7'*b*. The second passage part 25'*b* has the second throttle portion 7'*h* formed by reducing the inside diameter of the front end portion of the second shaft portion 7'*b*.

Refrigerant passing through the passages 22, 23, 24 in FIG. 1 and the second passage part 25'*b* of the passage 25' in FIG. 7 is heated by cooling the surroundings. The second throttle portion 7'*h* functions to decompress the heated refrigerant thereby to reduce its temperature.

According to the compressor 1', of the second preferred embodiment having the second throttle portion 7'*h* in the supply passage between the control valve 21 and the communication port 26*a*, the temperature of refrigerant that reaches the communication port 26*a*is reduced by the second throttle portion 7'*h*, with the result that the lip seal 8 is effectively cooled.

The position where the second throttle portion 7'*h* is provided is not limited to the front end of the second shaft portion 7'*b*, but the second throttle portion may be formed as a part of the supply passage in the drive shaft 7 in an alternative embodiment to the second preferred embodiment. For example, the second throttle portion may be provided at the rear end or halfway of the second passage part 25'*b*. Alternatively, it may be provided at the front end, rear end or halfway of the first passage part 25'*a*. Particularly, providing the second throttle portion near the front end of the first passage part 25'*a*, that is, near the passage 26 of FIG. 1, the distance of the path between the second throttle portion and the lip seal 8 is shortened. Thus, refrigerant cooled at the second throttle portion is prevented from being heated, so that the lip seal 8 is further efficiently cooled.

The second throttle portion may be formed separately from the second shaft portion 7'*b* unlike the one 7'*h* which is formed integrally with the second shaft portion 7'*b* as shown in FIG. 7. The second throttle portion may be formed integrally with the first shaft portion 7'*a* or may be formed separately therefrom. Providing the second throttle portion separately from the first or second shaft portions 7'*a* or 7'*b*, these shaft portions 7'*a*, 7'*b* may be made simple and hence easy to manufacture.

Figure 8:
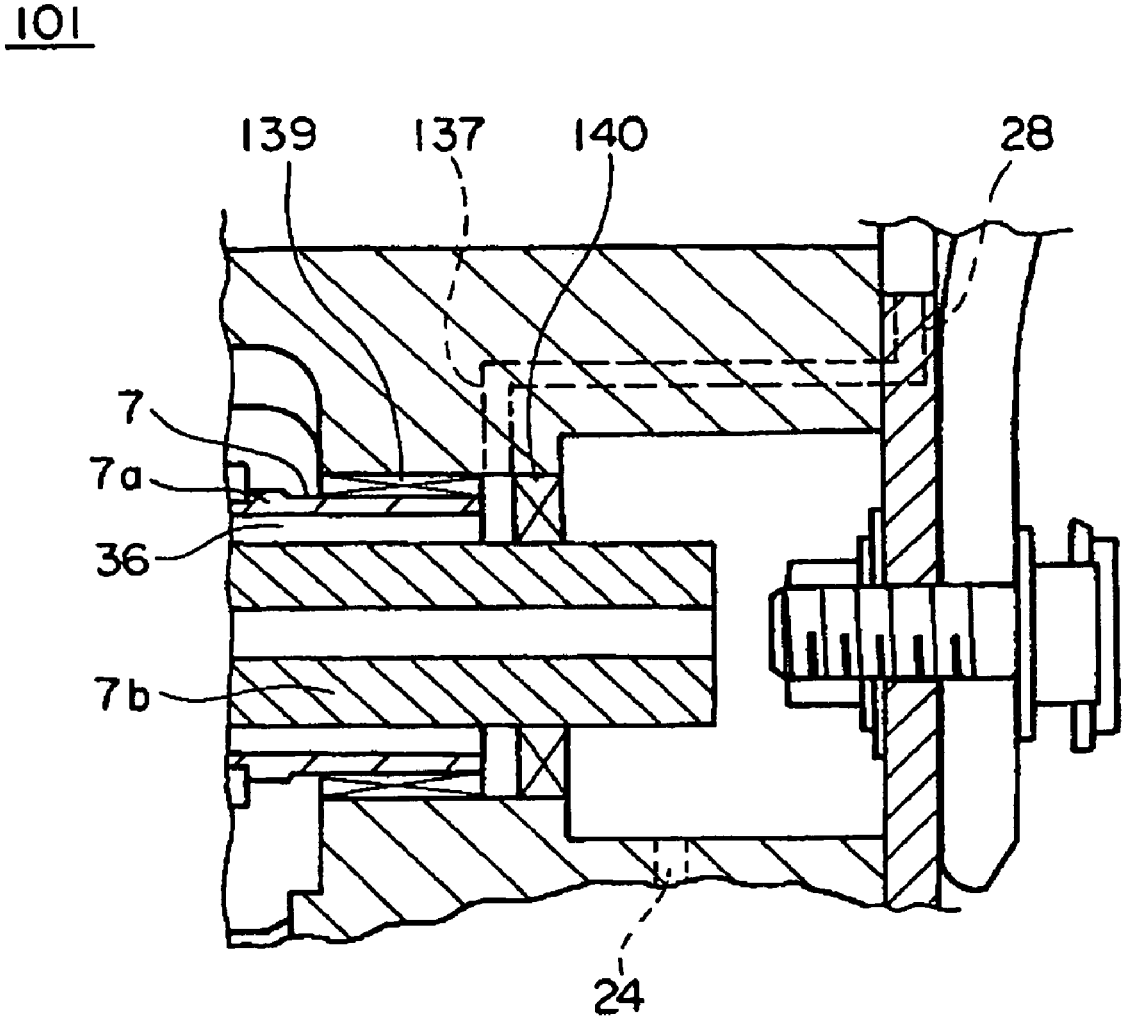
FIG. 8 is a partially cross-sectional view of a swash plate type compressor according to a third preferred embodiment of the present invention.

The following will describe a third preferred embodiment of a swash plate type compressor 101 according to the present invention with reference to FIG. 8.

The third preferred embodiment differs from the first preferred embodiment in that the structure around the rear end of the drive shaft 7 is modified as shown in FIG. 8. Referring to FIG. 8, the first shaft portion 7*a* is supported by a first bearing 139 or a plain bearing, and the second shaft portion 7*b* is supported by a second bearing 140 which is also a plain bearing.

In the third preferred embodiment, the lip seal 38 of the first preferred embodiment is not provided. Instead, the second bearing 140 is provided for sealing the passage 24 which is a part of the supply passage, from the passage 36 which is a part of the bleed passage. It is noted that the pressure differential between the supply passage and the bleed passage is small enough for the plain bearing 140 to seal the supply passage from the bleed passage.

According to the third preferred embodiment, the lip seal 38 is replaced by the plain bearing 140 having a higher durability, with the result that durability of the compressor 101 is improved.

Figure 9:
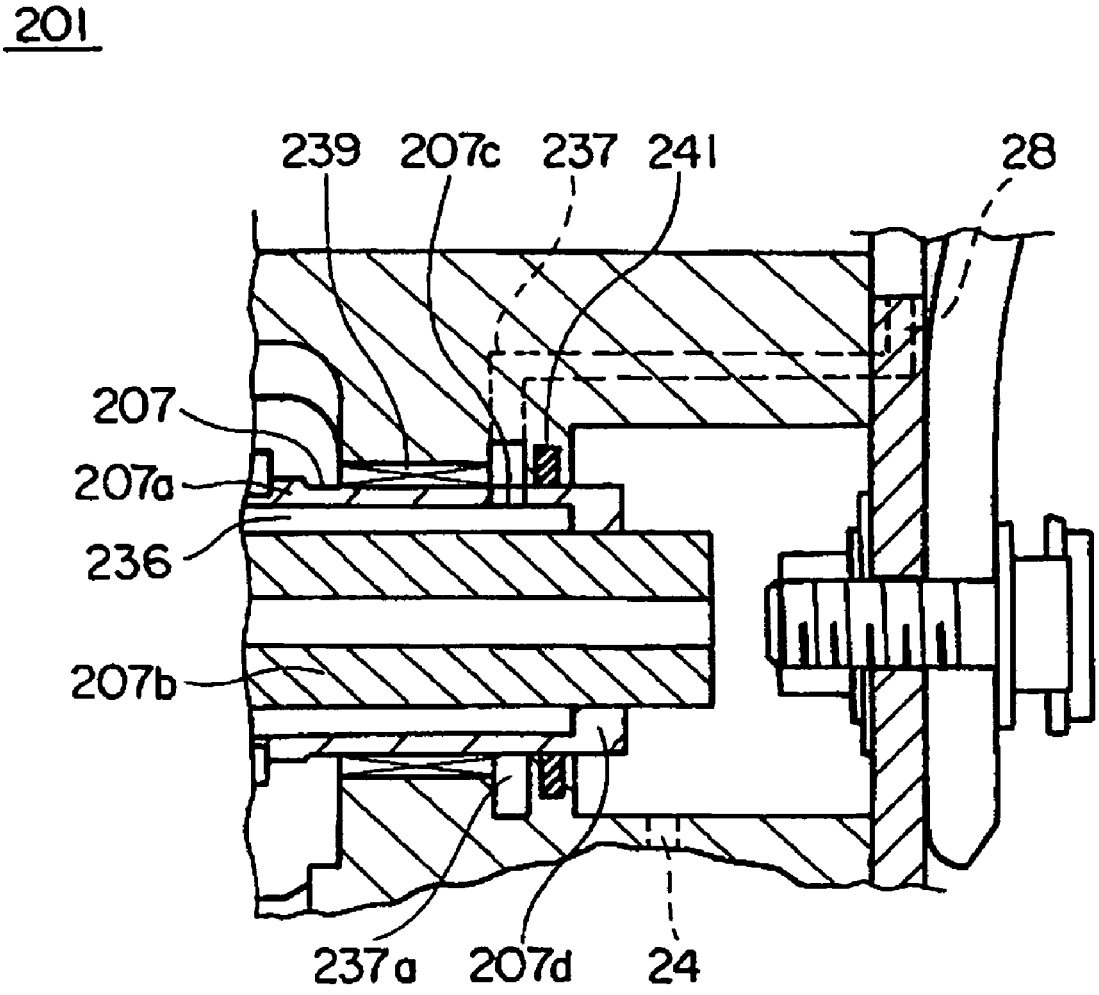
FIG. 9 is a partially cross-sectional view of a swash plate type compressor according to a fourth preferred embodiment of the present invention.

The following will describe a fourth preferred embodiment of a swash plate type compressor 201 according to the present invention with reference to FIG. 9. The fourth preferred embodiment differs from the first preferred embodiment in that the structure around the rear end of the drive shaft 7 is modified into a drive shaft 207 as shown in FIG. 9. Though not shown in FIG. 9, the general structure of the drive shaft 207 is substantially the same as the drive shaft 7 of FIG. 1.

Referring to FIG. 9, the first shaft portion 207*a* is supported by a first bearing 239 or a plain bearing. An O-ring 241 is provided for sealing the supply passage from the bleed passage. The first shaft portion 207*a* has at its rear end a small diameter portion 207*d* whose inner diameter is reduced. The small diameter portion 207*d* is fitted around a second shaft portion 207*b*. Furthermore, the first shaft portion 207*a* has a communication hole 207*c* that connects a passage 236 to a passage 237. A communication groove 237*a* is formed in the passage 237 adjacent to the communication hole 207*c*, surrounding the first shaft portion 207*a* so that the communication groove 237*a* is in constant communication with the passage 236 irrespective of the position of the communication hole 207*c*.

According to the fourth preferred embodiment wherein the drive shaft 207 is so formed that the small diameter portion

207*d* of the first shaft portion 207*a* is directly fitted around the rear end of the second shaft portion 207*b*, the strength of the drive shaft 207 is improved.

An O-ring may be provided at a position where the small diameter portion 207*d* of the first shaft portion 207*a* is fitted around the second shaft portion 207b for ensuring the seal between the supply passage and the bleed passage.

Figure 10:
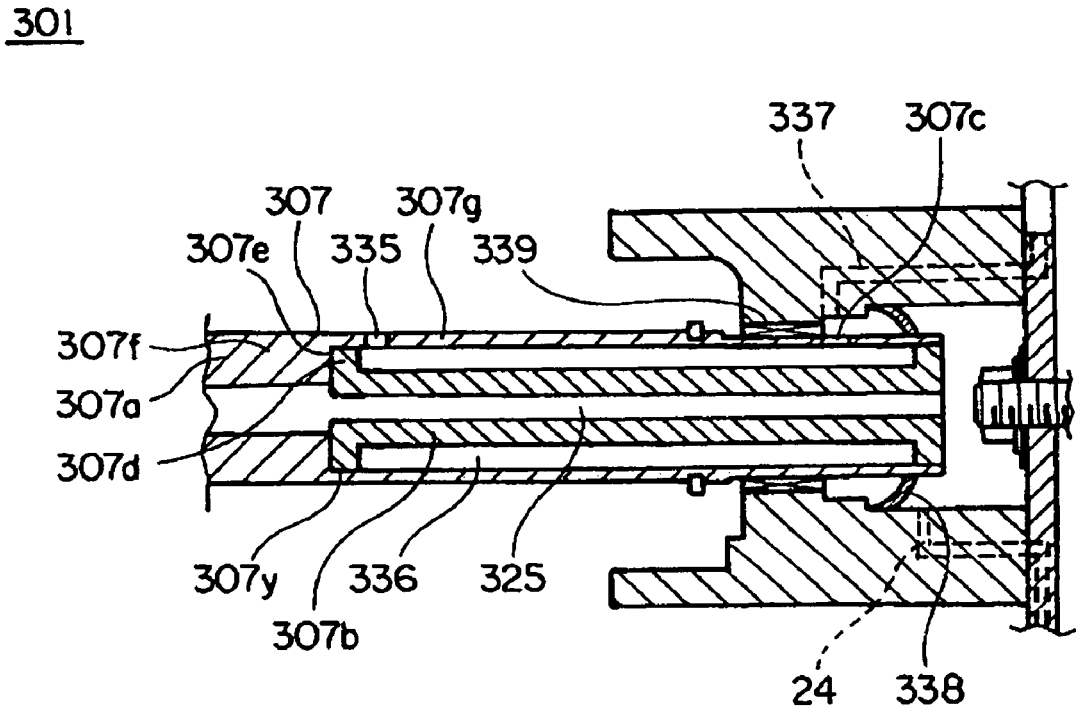
FIG. 10 is a partially cross-sectional view of a swash plate type compressor according to a fifth preferred embodiment of the present invention.

The following will describe a fifth preferred embodiment of a swash plate type compressor 301 according to the present invention with reference to FIG. 10. The fifth preferred embodiment differs from the first preferred embodiment in that the structure of or around the drive shaft 7 is modified as shown in FIG. 10. Though not shown in FIG. 10, the general structure of the drive shaft 307 is substantially the same as the drive shaft 7 of FIG. 1.

The drive shaft 307 includes a first shaft portion 307*a* and a second shaft portion 307*b*. The first shaft portion 307*a* has a small diameter portion 307*f* whose inner diameter is small and a large diameter portion 307*g* that has an inside diameter larger than the small diameter portion 307*f*. The second shaft portion 307*b* is press-fitted into the large diameter portion 307*g* of the first shaft portion 307*a*.

Figure 11:
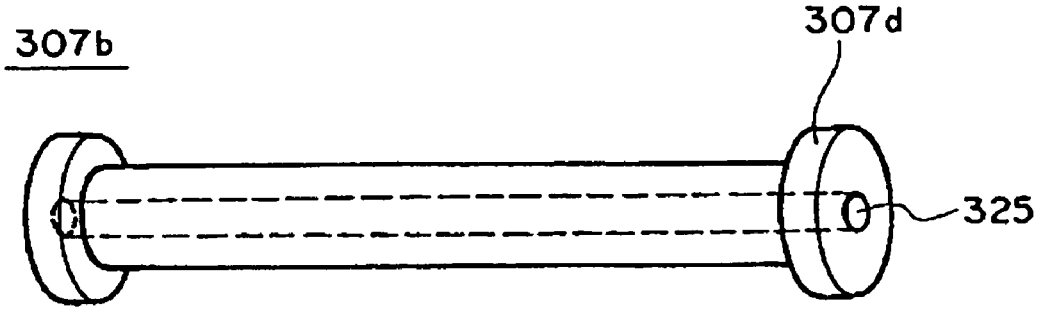
FIG. 11 is a perspective view of a second shaft of the swash plate type compressor according to the fifth preferred embodiment of the present invention.

Referring to FIG. 11 showing a perspective view of the second shaft portion 307*b*, it has a hollow cylinder and a flange 307*d* formed at the opposite ends of the cylinder and extending radially outside. The hollow portion provides a passage 325 in the compressor 301 which communicates with the passage 24. The flange 307*d* has an outside diameter that is substantially equal to the inside diameter of the large diameter portion 307*g* of the first shaft portion 307*a*, so that the passage 325 is so sealed with the flange 307*d* fitted in the large diameter portion 307*g*. Press-fitting the second shaft portion 307*b* into the first shaft portion 307*a*, the flange 307*d* on the front side of the second shaft portion 307*b* is engaged with a step 307*e* formed on the inner peripheral surface of the first shaft portion 307*a*. The inner peripheral surface of the first shaft portion 307*a* and the flange 307*d* cooperate to form a seal portion 307*y*.

A passage 335 is formed in the first shaft portion 307*a* at a position between the swash plate 11 and the lug plate 9 for drawing refrigerant from the crank chamber 9 into the suction chamber 18. The passage 335 is in communication with one end of a passage 336 which is formed between the inner peripheral surface of the large diameter portion 307*g* of the first shaft portion 307*a* and the outer peripheral surface of the second shaft portion 307*b*. The other end of the passage 336 is in communication with one end of a passage 337. The first shaft portion 307*a* has a communication hole 307*c* that connects the passage 336 to the passage 337. A lip seal 338 is provided around the first shaft portion 307*a* at the rear end thereof for sealing the supply passage from the bleed passage.

Figure 12:
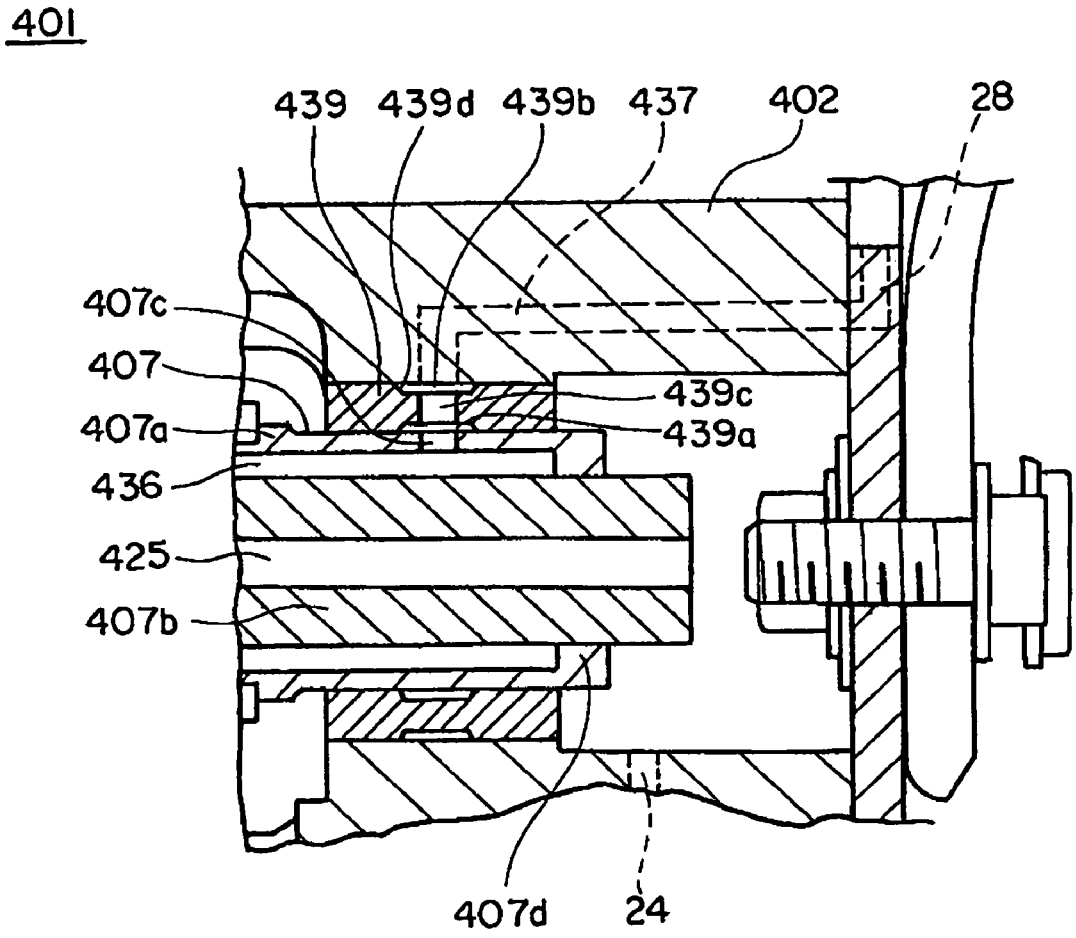
FIG. 12 is a partially cross-sectional view of a swash plate type compressor according to a sixth preferred embodiment of the present invention.
Figure 13:
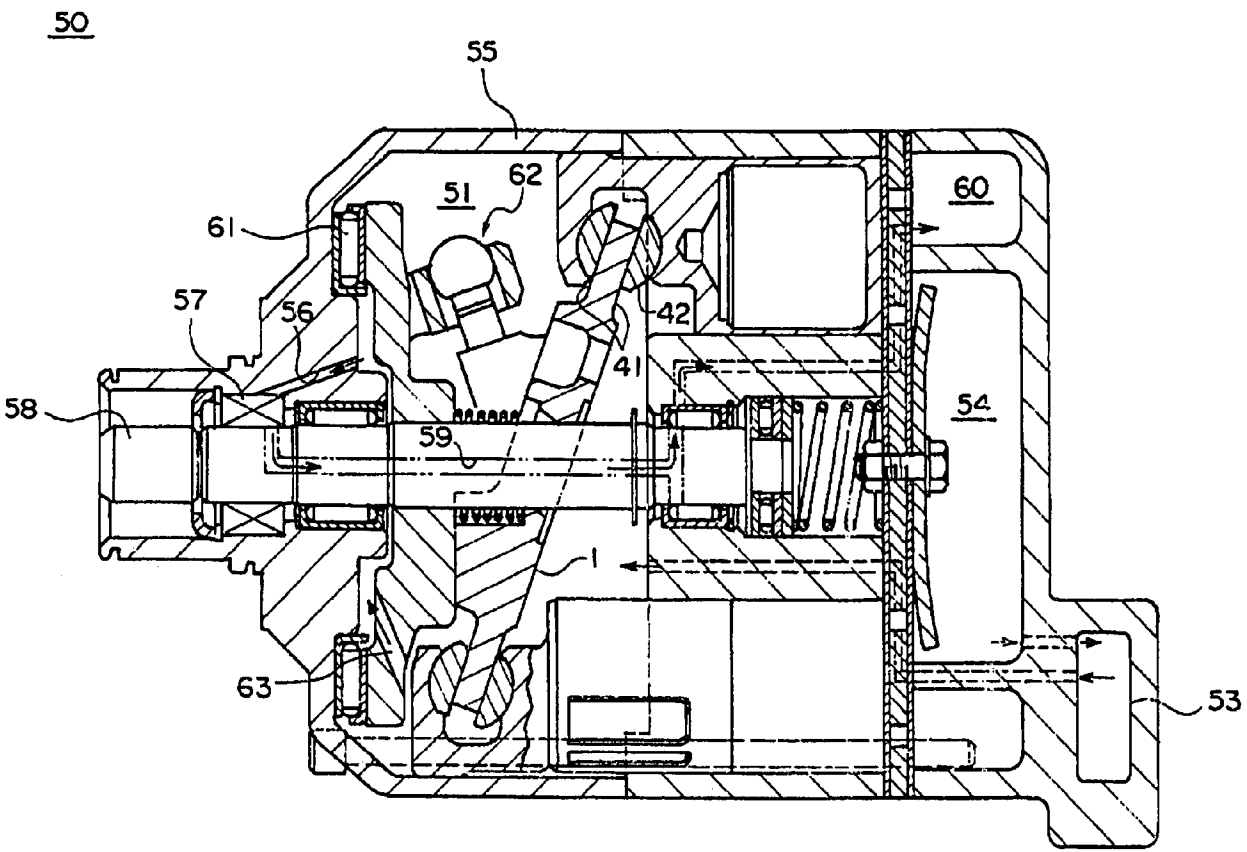
FIG. 13 (PRIOR ART)
FIG. 13 is a cross-sectional view of a swash plate type compressor according to a prior art.

The following will describe a sixth preferred embodiment of a swash plate type compressor 401 according to the present invention with reference to FIG. 12. The sixth preferred embodiment differs from the fourth preferred embodiment in that the structure of or around the drive shaft 207 is modified as shown in FIG. 12. Though not shown in FIG. 12, the general structure of the drive shaft 407 is substantially the same as the drive shaft 7 of FIG. 1.

Referring to FIG. 12, the rear end of the first shaft portion 407*a* of the drive shaft 407 is supported by a plain bearing 439. The first shaft portion 407*a* has at its rear end a small diameter portion 407*d* whose inner diameter is smaller. The small diameter portion 407*d* of the first shaft portion 407*a* is fitted around the second shaft portion 407*b*, thereby sealing a passage 436 in the drive shaft 407 from the passages 24, 425. Furthermore, the first shaft portion 407*a* has a communication hole 407*c* that connects the passage 436 to the outside of the first shaft portion 407*a*. The plain bearing 439 is provided in contact with the terminal end of the passage 436, that is, over the communication hole 407*c* through which the passage 436 is in communication with the outside of the first shaft portion 407*a*.

The plain bearing 439 has an inner annular groove 439*a* and an outer annular groove 439*b* on the inner peripheral surface and the outer peripheral surface thereof, respectively. The inner annular groove 439*a* and the outer annular groove 439*b* are located, for example, at the axial center of the plain bearing 439. Each of the inner annular groove 439*a* and the outer annular groove 439*b* has tapered surfaces 439*d* on its front and rear ends, respectively. The inner annular groove 439*a* is in communication with the outer annular groove 439*b* through a bearing communication hole 439*c* that extends through the plain bearing 439.

The plain bearing 439 is fixed to the cylinder block 402, so that relative position between the communication hole 407*c* and the bearing communication hole 439*c* varies with rotation of the drive shaft 407, but the inner annular groove 439*a* is maintained in constant communication with the communication hole 407*c* and the passage 437, irrespective of the position of the bearing communication hole 439*c*. Therefore, the passage 436 is constantly in communication with the passage 437.

The passage 35 (shown in FIG. 1), the passage 436, the communication hole 407*c*, the inner annular groove 439*a*, the bearing communication hole 439*c*, the outer annular groove 439*b*, the passage 437 and the passage 28 in FIG. 12 cooperate to form the bleed passage for drawing therethrough refrigerant in the crank chamber 6 into the suction pressure region.

The pressure differential between the passages 24, 425 that are part of the supply passage and the inner annular groove 439*a*, the outer annular groove 439*b* and the bearing communication hole 439*c* that are part of the bleed passage is small enough for the plain bearing 439 to seal successfully the supply passage from the bleed passage.

According to the sixth preferred embodiment wherein the plain bearing 439 which is provided at the rear end of the drive shaft 407 functions not only as a support for the drive shaft 407 but also as a seal for the supply passage and the bleed passage, there is no need for providing an additional member such as partition wall for sealing the supply passage from the bleed passage and, therefore, the structure of the compressor becomes simple. At the rear end of the drive shaft 407, the bleed passage is not formed outside or at the end of the plain bearing 439 supporting the drive shaft 407, but formed inside thereof (or halfway the plain bearing 439 as seen in the axial direction thereof). Therefore, lubricating oil contained in refrigerant that flows through the bleed passage flows through the entire plain bearing 439, thereby further efficiently lubricating the plain bearing 439.

In the sixth preferred embodiment, the inner annular groove 439*a*, the outer annular groove 439*b* and the bearing communication hole 439*c* are provided at the axial center of the plain bearing 439. It is noted, however, that the position of the inner and outer annular grooves 439*a*, 439*b* may be changed to halfway the plain bearing 439 as viewed in its axial direction. The position may be changed so as to achieve efficient sealing effect, for example, in view of the above pressure differential.

Additionally, the inner annular groove 439*a* may be formed not on the inner peripheral surface of the plain bearing 439 but on the outer peripheral surface of the first shaft portion 407*a*. Similarly, the annular groove 439*b* does not have to be formed necessarily on the outer peripheral surface of the plain bearing 439, but it may be formed in the inner peripheral surface of the cylinder block 402. By so providing the annular grooves 439*a*, 439*b*, the plain bearing 439 is improved in strength.

Therefore, the present examples and embodiments are to be considered as illustrative and not restrictive, and the invention is not to be limited to the details given herein but may be modified within the scope of the appended claims.

What is claimed is:

1. A swash plate type compressor comprising:

a housing having a cylinder bore, a suction pressure region, a discharge pressure region and a crank chamber;

a drive shaft rotatably supported by the housing, wherein the drive shaft includes:

a cylindrical hollow first shaft portion; and a cylindrical hollow second shaft portion fitted in the first shaft portion, a lug plate secured to the drive shaft;

a swash plate tiltably coupled to the lug plate;

a piston coupled to the swash plate and reciprocally accommodated in the cylinder bore, wherein refrigerant in the discharge pressure region is introduced into the crank chamber through a supply passage while the refrigerant in the crank chamber is drawn out to the suction pressure region through a bleed passage for controlling pressure in the crank chamber, whereby inclination angle of the swash plate is changed; and a heat-generating sliding portion provided in the crank chamber, wherein the supply passage includes:

a communication port that communicates with the crank chamber; and a first throttle portion for throttling the refrigerant, wherein a part of the bleed passage is defined by an inner peripheral surface of the first shaft portion and an outer peripheral surface of the second shaft portion, wherein a part of the supply passage is defined by an inner peripheral surface of the second shaft portion.

2. The swash plate type compressor according to claim 1, wherein the bleed passage includes a communication port that communicates with the crank chamber at a position between the lug plate and the swash plate.

3. The swash plate type compressor according to claim 1, wherein at least a part of the first shaft portion or the second shaft portion is made of heat insulation material.

4. The swash plate type compressor according to claim 3, wherein the heat insulation material is resin.

5. The swash plate compressor according to claim 1, wherein the compressor further comprising a seal member provided at an end portion of the second shaft portion, wherein the part of the bleed passage is defined by the inner peripheral surface of the first shaft portion, the outer peripheral surface of the second shaft portion and the seal member, and wherein the part of the supply passage is defined by the inner peripheral surface of the second shaft portion and the seal member.

6. The swash plate type compressor according to claim 1, wherein the first shaft portion and the second shaft portion are formed coaxially with each other.

7. The swash plate type compressor according to claim 1, wherein the second shaft portion is fitted to the first shaft portion so that an axis of the second shaft portion is offset from an axis of the first shaft portion.

8. The swash plate type compressor according to claim 1, wherein a part of the inner peripheral surface of the first shaft portion is in the contact with a part of the outer peripheral surface of the second shaft portion.

9. The swash plate type compressor according to claim 1, wherein the drive shaft includes:

a cylindrical hollow first shaft portion; and a cylindrical hollow second shaft portion fitted in the first shaft, wherein the second shaft portion has a flange formed at opposite ends thereof and extending radially outside, wherein an inner peripheral surface of the first shaft portion and the flanges cooperate to form a seal portion, wherein the bleed passage formed in the drive shaft is defined by an inner peripheral surface of the first shaft portion, an outer peripheral surface of the second shaft portion and the seal portion, and wherein the supply passage formed in the drive shaft is defined by an inner peripheral surface of the second shaft portion and the seal portion.

10. The swash plate type compressor according to claim 1, wherein the heat-generating sliding portion is a lip seal provided around the drive shaft for sealing of the crank chamber from an outside of the housing.

11. The swash plate type compressor according to claim 1, wherein the heat-generating sliding portion is a thrust bearing provided between the lug plate and the housing.

12. The swash plate type compressor according to claim 1, wherein the heat-generating sliding portion is a link which tiltably couples the swash plate to the lug plate.

13. The swash plate type compressor according to claim 1, wherein the supply passage further includes a second throttle portion between the first throttle portion and the communication port of the supply passage which communicates with the crank chamber.

14. The swash plate type compressor according to claim 1, further comprising:

a bearing provided in the housing for supporting the drive shaft, the bearing having a communication hole that extends therethrough, wherein the communication hole is a part of the bleed passage.

* * * * *